US008692102B2

(12) United States Patent
Kondo et al.

(10) Patent No.: US 8,692,102 B2
(45) Date of Patent: Apr. 8, 2014

(54) PICKUP CABLE FOR STRINGED INSTRUMENT

(71) Applicants: Kazuhisa Kondo, Tokyo (JP); Pen-Hao Ma, Tokyo (JP); Yoshiaki Abe, Tokyo (JP)

(72) Inventors: Kazuhisa Kondo, Tokyo (JP); Pen-Hao Ma, Tokyo (JP); Yoshiaki Abe, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 0 days.

(21) Appl. No.: 13/916,658

(22) Filed: Jun. 13, 2013

(65) Prior Publication Data

US 2013/0333546 A1 Dec. 19, 2013

(30) Foreign Application Priority Data

Jun. 15, 2012 (JP) ..... 2012-135481

(51) Int. Cl.
*G10H 3/12* (2006.01)

(52) U.S. Cl.
USPC ..... 84/723; 84/743

(58) Field of Classification Search
USPC ..... 84/723, 743, 733
See application file for complete search history.

(56) References Cited

U.S. PATENT DOCUMENTS

| | | | | | |
|---|---|---|---|---|---|
| 2,430,717 | A * | 11/1947 | Hull | 84/723 |
| 2,439,551 | A * | 4/1948 | Teikowski | 84/723 |
| 3,935,782 | A * | 2/1976 | O'Brien | 84/743 |
| 4,404,885 | A * | 9/1983 | Salak | 84/329 |
| 4,519,287 | A * | 5/1985 | Naruse | 84/743 |
| 4,570,522 | A * | 2/1986 | May | 84/723 |
| 5,010,803 | A * | 4/1991 | Donnell | 84/743 |
| 5,194,686 | A * | 3/1993 | Winkler | 84/743 |
| 5,614,688 | A * | 3/1997 | Donnell | 84/743 |
| 5,837,912 | A * | 11/1998 | Eagen | 84/267 |
| 6,441,292 | B1 * | 8/2002 | Donnell | 84/723 |
| 7,446,255 | B2 * | 11/2008 | Yamaya | 84/731 |
| 7,476,798 | B1 * | 1/2009 | Beller et al. | 84/743 |
| 7,804,018 | B2 * | 9/2010 | Tamura | 84/731 |
| 7,844,069 | B2 * | 11/2010 | Banks | 381/361 |
| 2005/0087062 | A1 * | 4/2005 | Kiyohiko | 84/723 |
| 2006/0011049 | A1 * | 1/2006 | Takabayashi | 84/734 |
| 2007/0245884 | A1 * | 10/2007 | Yamaya | 84/731 |

FOREIGN PATENT DOCUMENTS

JP 2006-047946 2/2006

* cited by examiner

*Primary Examiner* — David S. Warren
(74) *Attorney, Agent, or Firm* — Whitham Curtis Christoffersonf & Cook, PC

(57) ABSTRACT

A pickup cable for a stringed instrument can switch between the output of the direct vibrational sound of strings and the output of the sound from the stringed instrument body generated by the vibrations of the strings and can also simultaneously output both the sound components. The pickup cable for a stringed instrument includes an input terminal to be inserted in a jack of the stringed instrument; a microphone to collect and convert sound of an internal space of the stringed instrument into collected-sound electrical signals; and an output terminal to output the collected-sound electrical signals. The microphone is incorporated in the input terminal.

9 Claims, 10 Drawing Sheets

PICKUP CABLE FOR STRINGED INSTRUMENT

TECHNICAL FIELD

The present invention relates to a pickup cable for a stringed instrument.

BACKGROUND ART

Stringed instruments, such as guitars, ukuleles, and violins, produce sound through the vibrations of their tightly stretched strings. The sound produced by a stringed instrument consists of two components: sound directly produced by the vibrations of a string (vibration sound) and sound produced by the resonance of the body (housing) of the stringed instrument accompanied with the vibrations of a string (resonant sound). Each of these sound components of a stringed instrument is converted into electrical signals which will be amplified with an amplifier. Pickups are known as mechanisms that convert such sound components of stringed instruments into electrical signals and output them.

The pickups are classified into several types, each of which has its own characteristics. For example, an "in-bridge pickup," incorporated in bridge of a stringed instrument, converts the vibrations of the strings into electrical signals and outputs them. Thus, the in-bridge pickup can decrease the proportion of other sound components than that generated by the vibrations of the strings compared with collection of sound through a microphone provided close to the strings, so that the in-bridge pickup is suitable to efficiently output the sound of the strings. However, the in-bridge pickup is unsuitable for the output of the eigentone of the body of the stringed instrument (e.g., the resonant sound from the housing).

An "attachable pickup," which is attached to the body of a stringed instrument, converts sound from a housing into electrical signals and outputs them. Thus, the attachable pickup is more suitable for the output of the eigentone of the stringed instrument body than the in-bridge pickup. The attachable pickup, nevertheless, must be tuned depending on complicated vibration characteristics of the housing since this pickup is attached to the surface of the housing with a dual sided tape or an adhesive. Furthermore, this pickup may cause scratches on the surface of the housing. The attachable pickup thus involves troublesome fixation and tuning.

Another type of pickup intended to address such circumstances has been disclosed, for example, in Japanese Patent Laid-Open No. 2006-47946. This pickup is fixed through a piezoelectric element close to a bridge without an adhesive. The pickup disclosed in the unexamined patent can convert the vibrations of a housing into electrical signals; hence, the pickup can accurately output the intrinsic sound of the stringed instrument, including the resonant sound component of the housing, in addition to the vibrational sound component of the strings. Unfortunately, the pickup disclosed in Japanese Patent Laid-Open No. 2006-47946, which is also fixed to the housing, requires attachment and tuning. Moreover, the risks of scratching the surface of the housing still remain.

The conventional pickup mechanisms have both advantages and disadvantages as described above. Thus, characteristics required for a pickup are simple attachment and tuning, and ready output of both direct vibrational sound of the strings and intrinsic sound of the stringed instrument.

SUMMARY OF INVENTION

Technical Problem

An object of the present invention, which has been accomplished in view of such circumstances, is to provide a pickup cable for a stringed instrument that can readily output both the vibrational sound produced by the vibrations of strings and the sound of the internal space of the stringed instrument (e.g., the resonant sound of the stringed instrument body) without a particular pickup mechanism in the stringed instrument.

Solution to Problem

The present invention relates to a pickup cable for a stringed instrument that includes an input terminal to be inserted in a jack of the stringed instrument; a microphone to collect and convert sound of an internal space of the stringed instrument into collected-sound electrical signals; and an output terminal to output the collected-sound electrical signals. The microphone is incorporated in the input terminal.

Advantageous Effects of Invention

The pickup cable of the present invention can readily output both the vibrational sound produced by the vibrations of strings and the sound of the internal space of a stringed instrument (e.g., the resonant sound from the instrument body).

DESCRIPTION OF EMBODIMENTS

Example of Pickup Cable Used for Guitar

Figure 1:
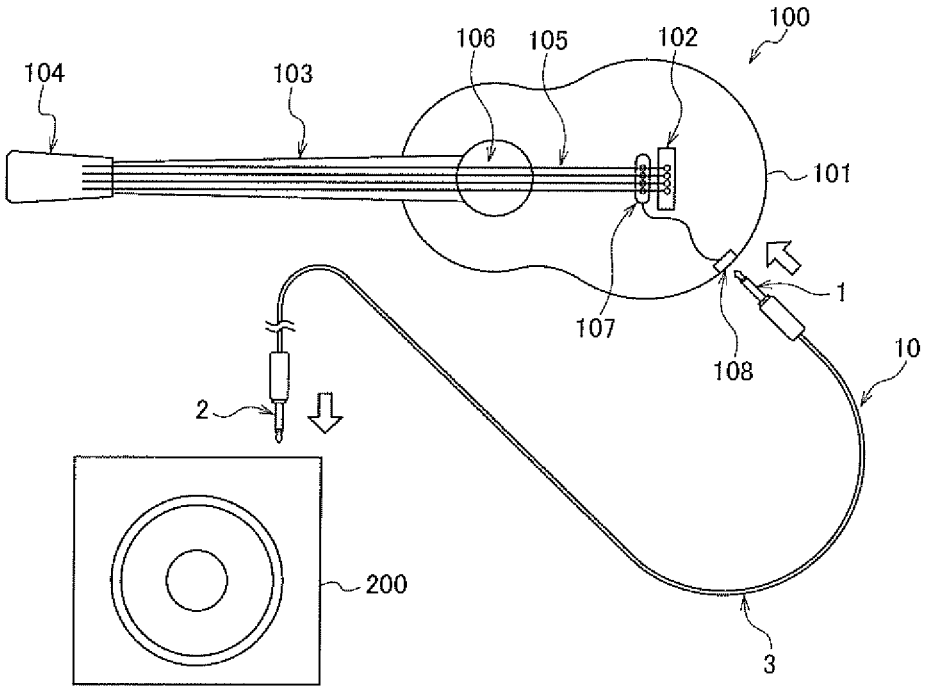
FIG. 1 illustrates an embodiment of a pickup cable for a stringed instrument according to the present invention, the pickup cable being used for a guitar, which is a typical stringed instrument.

An embodiment of a pickup cable for a stringed instrument according to the present invention will now be described below. FIG. 1 illustrates a guitar 100, which is a typical stringed instrument, and an amplifier 200 connected thereto via a pickup cable for a stringed instrument (hereinafter, simply referred to as "pickup cable") 10.

The guitar 100 in FIG. 1 includes a body 101, a bridge 102, a neck 103, a head 104, and strings 105. The strings 105, parallel to each other, are tightly stretched along the neck 103. The strings are held by the bridge 102 at one end and are fixed to the head 104 at the other end. The tightness of the strings 105 is adjusted at the head 104.

The body 101 of the guitar 100 has a hollow interior and a hole 106 adjacent to the tightly stretched strings 105 and in communication with the hollow interior. When a player vibrates the strings 105, the vibrations enter the hollow interior (internal space) of the body 101 through the hole 106, resulting in resonance in the hollow interior. The sound in the internal space (e.g., the resonant sound) is the intrinsic sound of the guitar 100.

A pickup 107 is provided between the bridge 102 and the hole 106 and is closer to the bridge 102. The pickup 107, for example, includes a piezoelectric element and is positioned so as to come into contact with the strings 105 fixed to the bridge 102.

The vibrations of the strings 105 cause variations in the pressure applied to the piezoelectric element in the pickup 107 and electrical signals are output depending on the variable pressure. The electrical signals depending on the vibrations of the strings are output from the pickup 107 as pickup electrical signals. The electrical signals from the pickup 107 are output from a jack 108 provided in the body 101 through a pickup circuit (not shown). The jack 108 receives an input terminal 1 of the pickup cable 10.

First Configuration of Pickup Cable

Figure 2:
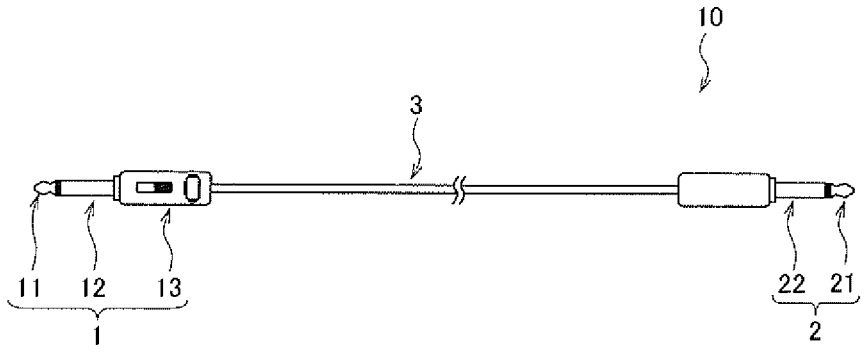
FIG. 2 is a plan view illustrating an embodiment of the pickup cable for a stringed instrument.

The configuration of the pickup cable for a stringed instrument according to the present invention will now be described. FIG. 2 is a plan view illustrating an embodiment of the pickup cable 10. The pickup cable 10 in FIG. 2 includes the input terminal 1, an output terminal 2, and a cable 3 for connecting the input terminal 1 to the output terminal 2.

The input terminal 1 is a monaural male plug and includes an input tip electrode 11, an input sleeve electrode 12, and a switching unit 13. The configuration of the switching unit 13 will be described in detail later. The output terminal 2 is also a monaural male plug and includes an output tip electrode 21 and an output sleeve electrode 22.

Figure 3:
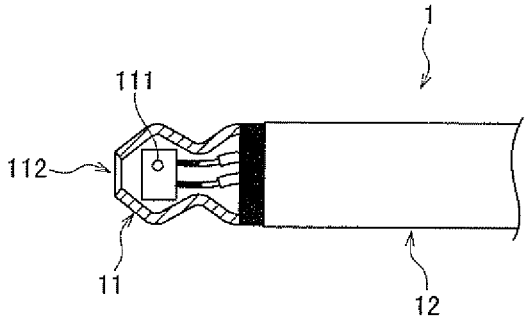
FIG. 3 is a longitudinal cross-sectional view of an input terminal of the pickup cable for a stringed instrument.

FIG. 3 is an enlarged longitudinal cross-sectional view of the cusp of the input terminal 1. The input tip electrode 11 of the input terminal 1 includes a microphone (internal microphone 111) therein, as illustrated in FIG. 3. The internal microphone 111 may be of a condenser, dynamic, or other type as appropriate. The condenser microphone operates with a battery in the switching unit 13 described later.

The output terminal of the internal microphone 111 is connected to the output terminal 2 via the cable 3. The connection will be described in detail later. The cusp of the input tip electrode 11 has an opening 112 for the entrance of sound to be collected by the internal microphone 111.

Mechanism of Sound Collection

Figure 4:
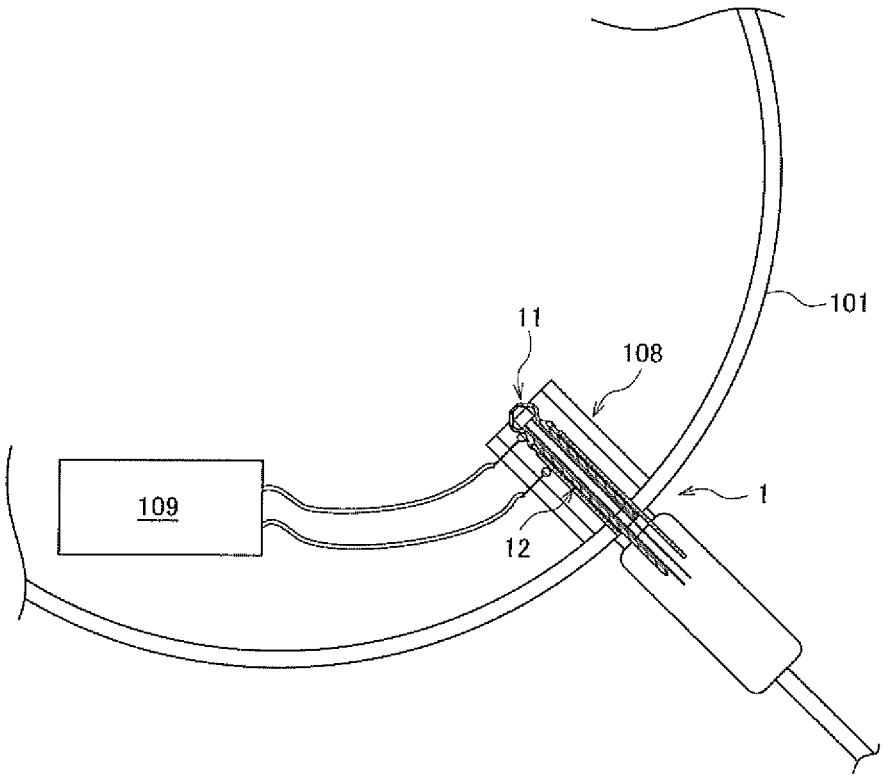
FIG. 4 is an enlarged longitudinal cross-sectional view illustrating the pickup cable plugged in the stringed instrument.

The mechanism of collecting the sound of the internal space (e.g., the resonant sound) of the guitar 100 by the pickup cable 10 will now be described. FIG. 4 is an enlarged cross-sectional view illustrating a part of the body 101 where the input terminal 1 is inserted in the jack 108. The jack 108 is a cylindrical member and extends from the external wall of the body 101 to the hollow interior (internal space) of the body 101. The jack 108 is connected to a pickup circuit 109 for outputting electrical signals (pickup electrical signals) from the pickup 107. The input tip electrode 11 and the input sleeve electrode 12 are electrically connected to a signal line and a ground line of the pickup circuit 109, respectively.

The jack 108 has a length that allows the cusp of the completely inserted input terminal 1 to reach the internal space of the body 101. The inside of the cusp of the input terminal 1 is in communication with the internal space of the body 101 through the opening 112. The sound of the internal space is thus collected by the internal microphone 111 through the opening 112 and is converted into electrical signals, referred to as collected-sound electrical signals. The collected-sound electrical signals resulting from the sound of the internal space of the body 101 can be output via the pickup cable 10 to the amplifier 200 (FIG. 1).

Connection of Pickup Cable 10

Exemplary connection of the pickup cable 10 according to the present embodiment will now be described with reference to FIG. 5. The input tip electrode 11 and the output tip electrode 21, each merely referred to as "tip," are connected to the signal line, while the input sleeve electrode 12 and the output sleeve electrode 22, each merely referred to as "sleeve," are connected to the ground line.

Figure 5:
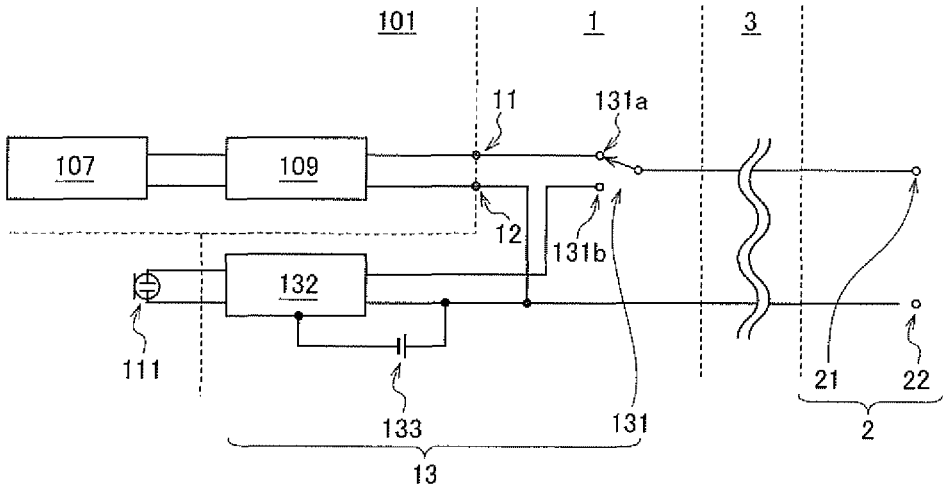
FIG. 5 illustrates the connection of the pickup cable for a stringed instrument.

The pickup 107 is electrically connected to the input tip electrode 11 and the input sleeve electrode 12 via the pickup circuit 109, as illustrated in FIG. 5. The input tip electrode 11 is electrically connected to a first contact 131*a* of a changeover switch 131 incorporated in the switching unit 13. The input sleeve electrode 12 is electrically connected to the output sleeve electrode 22.

The internal microphone 111 is connected to a microphone driving circuit 132. The terminal of a signal line, which is one of the output terminals of the microphone driving circuit 132, is electrically connected to a second contact 131*b* of the changeover switch 131. The ground terminal, which is the other of the output terminals of the microphone driving circuit 132, and the input sleeve electrode 12 are electrically connected to the output sleeve electrode 22.

The microphone driving circuit 132 is connected to a battery 133 for driving the internal microphone 111.

The changeover switch 131 is electrically connected to the output tip electrode 21. If the switch is in contact with the first contact 131*a*, pickup electrical signals from the pickup 107 exit through the output terminal 2. If the switch is in contact with the second contact 131*b*, collected-sound electrical signals from the internal microphone 111 exit through the output terminal 2.

In this manner, the pickup cable 10 plugged in the jack 108 of the guitar 100 according to the present embodiment allows the switching unit 13 to change the changeover switch 131 to switch between the output of the pickup electrical signals from the pickup 107 and the output of the collected-sound electrical signals of the sound (e.g., the resonant sound) from the internal space of the body 101, as needed.

In summary, the pickup cable 10 enables the guitar 100 to switch between the output of the direct sound (the vibration sound) of the strings 105 and the output of the intrinsic sound (the sound of the internal space) of the guitar 100, as needed, without changing the conventional configuration, i.e., without a novel pickup mechanism and attachment of another pickup mechanism to the body 101.

Second Configuration of Pickup Cable

Figure 6:
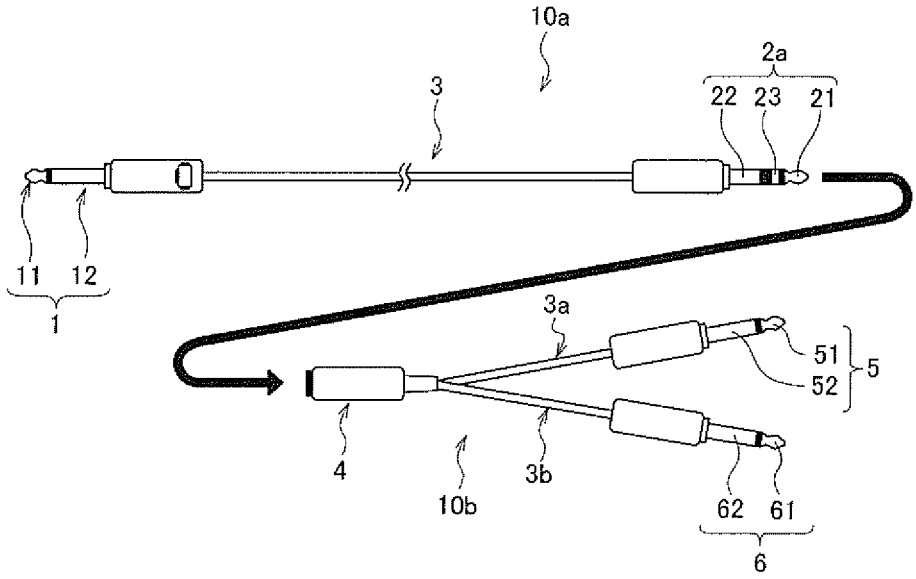
FIG. 6 is a plan view illustrating another embodiment of the pickup cable for a stringed instrument.

Another embodiment of the pickup cable according to the present invention will now described. FIG. 6 illustrates a pickup cable 10*a* and a branched cable 10*b*, which configure a pickup cable according to the present embodiment. That is, the branched cable 10*b* configures a part of the pickup cable according to the present invention. The pickup cable 10*a* in FIG. 6 includes an input terminal 1, an output terminal 2*a*, and a cable 3 for connecting the input terminal 1 to the output terminal 2*a*. The branched cable 10*b* includes a branching terminal 4 into which the output terminal 2*a* is to be plugged, and a first branch output terminal 5 and a second branch output terminal 6 both connectable to an amplifier 200 (not shown in FIG. 6).

The input terminal 1 is a monaural male plug and includes an input tip electrode 11 and an input sleeve electrode 12.

The output terminal 2*a* is a stereo male plug and has an output ring electrode 23 between an output tip electrode 21 and an output sleeve electrode 22 separated by insulating materials. The output ring electrode 23, merely referred to as "ring," is connected to the signal line.

Configuration of Branched Cable

The branched cable 10*b* is to be connected to the output terminal 2*a*. The branching terminal 4 receives the output terminal 2*a*. The branching terminal 4 includes a first contact terminal, a second contact terminal, and a third contact terminal. The first contact terminal comes into contact with the output tip electrode 21, which is a first output portion, to achieve electrical connection. The second contact terminal comes into contact with the output ring electrode 23, which is a second output portion, to achieve electrical connection. The third contact terminal comes into contact with the output sleeve electrode 22, to which the ground line is connected, to achieve electrical connection. Each contact terminal in the branching terminal 4 is connected to the first branch output terminal 5 via a first branched cable 3*a* or to the second branch output terminal 6 via a second branched cable 3*b*.

Connection of Pickup Cable 10*a*

Figure 7:
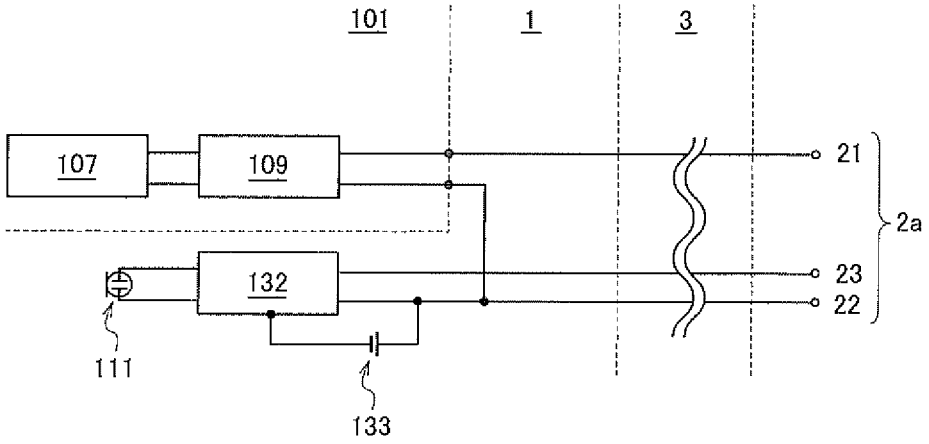
FIG. 7 illustrates the connection of the pickup cable for a stringed instrument in FIG. 6.

Exemplary connection of the pickup cable 10*a* will now be described with reference to FIG. 7. FIG. 7 illustrates the connection of the pickup cable 10*a*. A pickup 107 is electrically connected to the input tip electrode 11 and the input sleeve electrode 12 via a pickup circuit 109, as illustrated in FIG. 7. The input tip electrode 11 is electrically connected to the output tip electrode 21. The input sleeve electrode 12 is electrically connected to the output sleeve electrode 22.

An internal microphone 111 is connected to a microphone driving circuit 132. The terminal of the signal line, which is one of the output terminals of the microphone driving circuit 132, is electrically connected to the output ring electrode 23. The ground terminal, which is the other of the output terminals of the microphone driving circuit 132, and the input sleeve electrode 12 are electrically connected to the output sleeve electrode 22. The microphone driving circuit 132 is connected to a battery 133 for driving the internal microphone 111.

The connection thus allows the pickup and collected-sound electrical signals received through the input terminal 1 to exit through the output tip electrode 21 and the output ring electrode 23, respectively, which are the terminals of the two signal lines of the output terminal 2*a*.

Connection of Branched Cable

Figure 8:
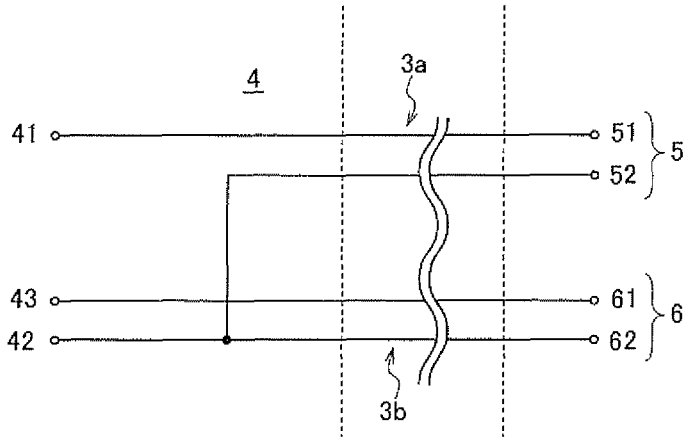
FIG. 8 illustrates the connection of an exemplary branched cable, which is a part of the pickup cable for a stringed instrument in FIG. 6.

Exemplary connection of the branched cable 10*b*, which is to be connected to the pickup cable 10*a*, will be described with reference to FIG. 8. The branching terminal 4 of the branched cable 10*b* includes a first contact terminal 41 to come into contact with the output tip electrode 21 for electrical connection, a second contact terminal 43 to come into contact with the output ring electrode 23 for electrical connection, and a third contact terminal 42 to come into contact with the output sleeve electrode 22 for electrical connection, as illustrated in FIG. 8.

The first contact terminal 41 is connected to a first branch output tip electrode 51 of the first branch output terminal 5 via the first branched cable 3*a*. The second contact terminal 43 is connected to a second branch output tip electrode 61 of the second branch output terminal 6 via the second branched cable 3*b*. The third contact terminal 42 is connected to a first branch output sleeve electrode 52 of the first branch output terminal 5 via the first branched cable 3*a* and also connected to a second branch output sleeve electrode 62 of the second branch output terminal 6 via the second branched cable 3*b*.

After the pickup cable 10*a* and the branched cable 10*b* are electrically connected to each other in response to the insertion of the output terminal 2*a* into the branching terminal 4, the pickup electrical signals from the pickup 107 enter the input tip electrode 11 of the input terminal 1, flow in the cable 3, and exit through the output tip electrode 21 of the output terminal 2. The pickup electrical signals from the output tip electrode 21 enter the first contact terminal 41, flow in the first branched cable 3*a*, and exit through the first branch output tip electrode 51.

The collected-sound electrical signals from the internal microphone 111 flow in the cable 3 to exit through the output ring electrode 23. The collected-sound electrical signals from the output ring electrode 23 enter the second contact terminal 43, flow in the second branched cable 3*b*, and exit through the second branch output tip electrode 61.

The input sleeve electrode 12 and the ground line of the internal microphone 111 are electrically connected to the output sleeve electrode 22 via the cable 3. The output sleeve electrode 22 is electrically connected to the first branch output sleeve electrode 52 via the third contact terminal 42 and the first branched cable 3*a*. The output sleeve electrode 22 is also electrically connected to the second branch output sleeve electrode 62 via the second branched cable 3*b*.

The pickup cable 10*a* and the branched cable 10*b* thus can output pickup electrical signals from the pickup 107 and collected-sound electrical signals from the internal microphone 111 through the input terminal 1 plugged in a jack 108 and can separately output to different destinations (e.g., an amplifier and a speaker) through the branched cable 10*b*.

In summary, the pickup cable according to the present invention includes the output terminal 2*a* having the first output portion 21 for outputting pickup electrical signals and the second output portion 23 for outputting collected-sound electrical signals. The pickup cable further includes the first contact terminal 41 to come into contact with the first output portion, the second contact terminal 43 to come into contact with the second output portion, the first branch output terminal 5 to output pickup electrical signals received from the first contact terminal, and the second branch output terminal 6 to output collected-sound electrical signals received from the second contact terminal.

It is noted that the pickup cable according to the present invention may also adopt any other connection than that between the pickup cable 10*a* and the branched cable 10*b* in the above embodiment. For example, the input terminal 1 may be directly connected to the first and second branch output terminals 5 and 6 without the output terminal 2*a* and the branching terminal 4. To provide this connection, the input tip electrode 11 of the input terminal 1 may be directly connected to the first branch output tip electrode 51 of the first branch output terminal 5, while the signal line of the internal microphone 111 may be directly connected to the second branch output tip electrode 61 of the second branch output terminal 6. In addition, the input sleeve electrode 12 and the ground line of the internal microphone 111 may be directly connected to the first branch output sleeve electrode 52 and the second branch output sleeve electrode 62, respectively.

The pickup cable for a stringed instrument according to the present invention allows a guitar 100 having a conventional configuration to output the direct vibrational sound of strings 105 from one apparatus and the intrinsic sound (sound of the internal space) of the guitar 100 from another apparatus, as hereinbefore described.

Third Configuration of Pickup Cable

Figure 9:
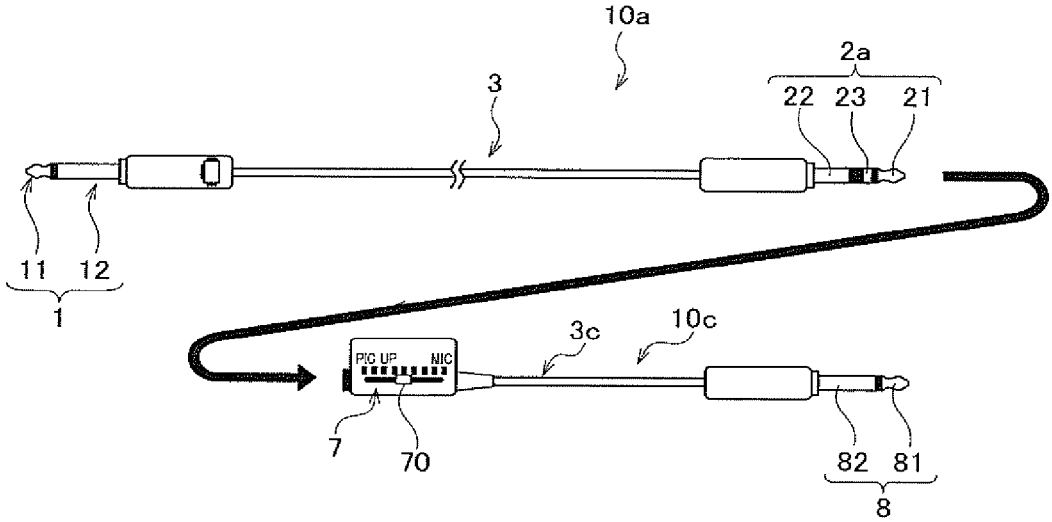
FIG. 9 is a plan view illustrating still another embodiment of the pickup cable for a stringed instrument.

Still another embodiment of the pickup cable according to the present invention will now described. FIG. 9 illustrates a pickup cable 10*a* and a mixer cable 10*c* including a mixer 7, which configure a pickup cable according to the present embodiment. That is, the mixer cable 10*c* configures a part of the pickup cable according to the present invention. The pickup cable 10*a* in FIG. 9 includes an input terminal 1, an output terminal 2*a*, and a cable 3 for connecting the input terminal 1 to the output terminal 2*a*. The mixer cable 10*c* includes the mixer 7 into which the output terminal 2*a* is to be plugged, and a mixer output terminal 8 connectable to an amplifier 200 (not shown in FIG. 9). The pickup cable 10*a* is the same as that described above; hence, the description thereof will be omitted.

Configuration of Mixer cable

The mixer cable 10*c* is to be connected to the output terminal 2*a* of the pickup cable 10*a* and includes the mixer 7, into which the output terminal 2*a* is to be inserted, and the mixer output terminal 8.

The mixer 7 includes a first contact terminal, a second contact terminal, and a third contact terminal. The first contact terminal comes into contact with an output tip electrode 21, which is the first output portion, to achieve electrical connection. The second contact terminal comes into contact with an output ring electrode 23, which is the second output portion, to achieve electrical connection. The third contact terminal comes into contact with an output sleeve electrode 22, which is a third output portion, to achieve electrical connection. Each contact terminal is connected to a mixer circuit 74. The mixer 7 is provided with a slide switch 70 which is an operation portion. The slide switch 70 can determine the mixing ratio between the above-mentioned two types of electrical signals input to the mixer 7 via the output terminal 2*a*. The mixer output terminal 8 includes a mixer output tip electrode 81 and a mixer output sleeve electrode 82.

Connection of Mixer Cable

Exemplary connection of the mixer cable 10*c*, which is to be connected to the pickup cable 10*a*, will now be described. The connection of the pickup cable 10*a* is the same as that illustrated in FIG. 7; hence, the description thereof will be omitted. The connection of the mixer cable 10*c* is illustrated in FIG. 10.

Figure 10:
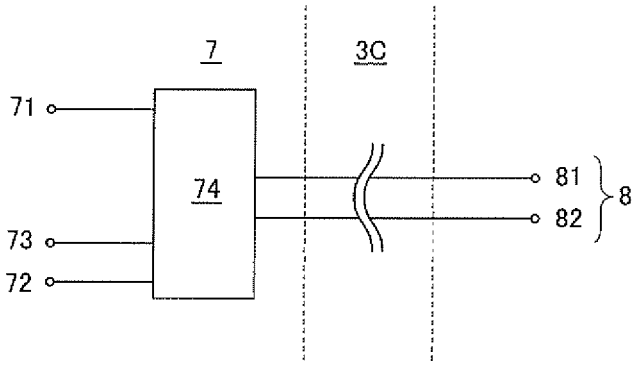
FIG. 10 illustrates the connection of an exemplary mixer cable, which is a part of the pickup cable for a stringed instrument in FIG. 9.

The mixer 7 in FIG. 10 includes a first contact terminal 71, a second contact terminal 73, and a third contact terminal 72. After the mixer 7 receives the output terminal 2*a* of the pickup cable 10*a*, the first contact terminal 71 comes into contact with the output tip electrode 21 to achieve electrical connection, the second contact terminal 73 comes into contact with the output ring electrode 23 to achieve electrical connection, and the third contact terminal 72 comes into contact with the output sleeve electrode 22 to achieve electrical connection.

The first contact terminal 71, the second contact terminal 73, and the third contact terminal 72 all function as input terminals of the mixer circuit 74.

After the pickup cable 10*a* is electrically connected to the mixer cable 10*c* in response to the insertion of the output terminal 2*a* into the mixer 7, the pickup electrical signals from a pickup 107 enter an input tip electrode 11 of the input terminal 1, flow in the cable 3, and exit through the output tip electrode 21 of the output terminal 2. The pickup electrical signals from the output tip electrode 21 enter the mixer circuit 74 via the first contact terminal 71.

The collected-sound electrical signals from an internal microphone 111 flow in the cable 3 to exit through the output ring electrode 23. The collected-sound electrical signals output from the output ring electrode 23 enter the mixer circuit 74 via the second contact terminal 73. An input sleeve electrode 12 and the ground line of the internal microphone 111 are electrically connected to the output sleeve electrode 22 via the cable 3. The output sleeve electrode 22 is electrically connected to a ground line of the mixer circuit 74 via the third contact terminal 72.

The mixer circuit 74 combines the pickup electrical signals received via the first contact terminal 71 with the collected-sound electrical signals received via the second contact terminal 73 in accordance with the position of the slide switch 70 (not shown in FIG. 10) and outputs the resultant signals. The signals output from the mixer circuit 74 exit through the mixer output tip electrode 81 and the mixer output sleeve electrode 82 of the mixer output terminal 8.

The pickup cable 10*a* and the mixer cable 10*c* thus allow electrical signals from the pickup 107 and electrical signals from the internal microphone 111, which signals can be received through the single input terminal 1, to be combined with each other at any mixing ratio and to be output to an output apparatus (e.g., amplifier 200).

In summary, the pickup cable according to the present invention includes the output terminal 2*a* having the first output portion 21 for outputting pickup electrical signals and the second output portion 23 for outputting collected-sound electrical signals. The pickup cable further includes the first contact terminal 71 to come into contact with the first output portion, the second contact terminal 73 to come into contact with the second output portion, the mixer 7 to output the mixed signals of the pickup electrical signals from the first contact terminal and the collected-sound electrical signals from the second contact terminal, and the mixer output terminal 8 to output the mixed signals. The mixer includes a determinator 74 for determining the mixing ratio between the pickup electrical signals from the first contact terminal and the collected-sound electrical signals from the second contact terminal.

It is noted that the pickup cable according to the present invention may also adopt any other connection than that between the pickup cable 10*a* and the mixer cable 10*c* in the above embodiment. For example, the cable 3 may be directly connected to the mixer 7 without the output terminal 2*a*. To provide this connection, the input tip electrode 11 of the input terminal 1 may be directly connected to the first contact terminal 71 of the mixer 7, while the signal line of the internal microphone 111 may be directly connected to the second contact terminal 73 of the mixer 7. In addition, the input sleeve electrode 12 and the ground line of the internal microphone 111 may be directly connected to the third contact terminal 72 of the mixer 7.

The pickup cable for a stringed instrument according to the present invention allows a guitar 100 having a conventional configuration to output the direct vibration sound of strings 105 and the intrinsic sound (sound of the internal space) of the guitar 100 at a readily adjusted mixing ratio.

What is claimed is:

1. A pickup cable for a stringed instrument, comprising:

an input terminal to be inserted in a jack of the stringed instrument;

a microphone to convert sound of an internal space of the stringed instrument into collected-sound electrical signals; and an output terminal to output the collected-sound electrical signals, wherein the microphone is incorporated in the input terminal.

2. The pickup cable for a stringed instrument according to claim 1, wherein the input terminal has an opening, and the microphone is disposed in a space in communication with an interior of the stringed instrument through the opening and collects the sound of the internal space.

3. The pickup cable for a stringed instrument according to claim 2, wherein the opening is provided at a cusp of the input terminal, and the microphone is disposed inside the cusp of the input terminal.

4. The pickup cable for a stringed instrument according to claim 3, wherein the microphone is disposed in the internal space.

5. The pickup cable for a stringed instrument according to claim 1, wherein the input terminal receives pickup electrical signals from a pickup of the stringed instrument through the jack, and the pickup electrical signals exit through the output terminal.

6. The pickup cable for a stringed instrument according to claim 5, wherein the output terminal is a stereo output terminal and includes a first output portion for outputting the pickup electrical signals and a second output portion for outputting the collected-sound electrical signals.

7. The pickup cable for a stringed instrument according to claim 5, wherein the output terminal comprises two monaural output terminals, one of the monaural output terminals outputs the pickup electrical signals, and the other of the monaural output terminals outputs the collected-sound electrical signals.

8. The pickup cable for a stringed instrument according to claim 5, further comprising a mixer to combine the pickup electrical signals with the collected-sound electrical signals, wherein the mixer includes a determinator to determine a mixing ratio between the pickup electrical signals and the collected-sound electrical signals, and the output terminal outputs mixed signals from the mixer.

9. The pickup cable for a stringed instrument according to claim 8, wherein the mixer includes an operation portion for determining the mixing ratio.

* * * * *